US011648593B2

(12) United States Patent
Distler et al.

(10) Patent No.: US 11,648,593 B2
(45) Date of Patent: May 16, 2023

(54) METHOD OF CLEANING A TORCH OF A PLASMA-COATING PLANT AND A PLASMA-COATING PLANT

(71) Applicant: OERLIKON METCO AG, WOHLEN, Wohlen (CH)

(72) Inventors: Bernd Distler, Elmont, NY (US); Peter Ernst, Stadel b. Niederglatt (CH)

(73) Assignee: OERLIKON METCO AG, WOHLEN, Wohlen (CH)

( * ) Notice: Subject to any disclaimer, the term of this patent is extended or adjusted under 35 U.S.C. 154(b) by 147 days.

(21) Appl. No.: 16/891,496

(22) Filed: Jun. 3, 2020

(65) Prior Publication Data

US 2020/0290097 A1 Sep. 17, 2020

Related U.S. Application Data

(62) Division of application No. 14/338,960, filed on Jul. 23, 2014, now abandoned.

(30) Foreign Application Priority Data

Jul. 26, 2013 (EP) ..... 13178146

(51) Int. Cl.
*B08B 7/00* (2006.01)
*B05B 15/55* (2018.01)
(Continued)

(52) U.S. Cl.
CPC ..... *B08B 7/0021* (2013.01); *B05B 15/555* (2018.02); *B05B 15/557* (2018.02); *B05B 7/226* (2013.01)

(58) Field of Classification Search
None
See application file for complete search history.

(56) References Cited

U.S. PATENT DOCUMENTS 5,365,699 A * 11/1994 Armstrong ..... B24C 1/003 451/75
8,292,698 B1 10/2012 Shih
(Continued)

FOREIGN PATENT DOCUMENTS

EP 1 837 081 9/2007
JP 63-224877 9/1988
(Continued)

OTHER PUBLICATIONS

EPO Search Report issued in counterpart EP application No. 13178146.0, dated Feb. 18, 2014.
(Continued)

*Primary Examiner* — Natasha N Campbell
*Assistant Examiner* — Pradhuman Parihar
(74) *Attorney, Agent, or Firm* — Greenblum & Bernstein, P.L.C.

(57) ABSTRACT

Method of cleaning a plasma coating torch utilizing at least one nozzle mounted so as to be directed at the plasma coating torch in order to subject an external surface of the plasma coating torch to a cleaning agent that removes spray material particles which have adhered to the external surface of the plasma coating torch during coating with the plasma coating torch, and such that the cleaning agent exiting the at least one nozzle and being directed toward the external surface and directly changing to a gaseous state from either a solid state or a liquid state.

14 Claims, 1 Drawing Sheet

(51) Int. Cl.
*B05B 15/555* (2018.01)
*B05B 7/22* (2006.01)

(56) References Cited

U.S. PATENT DOCUMENTS

| | | | | |
|---|---|---|---|---|
| 2001/0022995 | A1* | 9/2001 | Keller | C23C 4/16 427/457 |
| 2003/0024917 | A1 | 2/2003 | Thielmann | |
| 2004/0050834 | A1 | 3/2004 | Von Der Ohe | |
| 2005/0103883 | A1* | 5/2005 | Schroeder | B05B 14/10 239/104 |
| 2007/0221751 | A1 | 9/2007 | Lang | |
| 2009/0291235 | A1 | 11/2009 | Sanjurjo | |
| 2012/0298633 | A1 | 11/2012 | Riemann | |
| 2012/0308733 | A1 | 12/2012 | Von Niessen | |
| 2013/0284203 | A1* | 10/2013 | VanEvery | C23C 4/134 134/1.1 |

FOREIGN PATENT DOCUMENTS

| | | |
|---|---|---|
| JP | 7-9570 | 7/1995 |
| JP | 10258262 | 9/1998 |
| JP | 2002-035942 | 2/2002 |
| JP | 2010-096241 | 2/2010 |
| JP | 2011-167822 | 9/2011 |
| WO | WO2004/063416 | 7/2004 |
| WO | WO2012/082902 | 6/2012 |

OTHER PUBLICATIONS

Office Action issued in counterpart Chinese application No. 201410539478.1, dated Oct. 11, 2017.
Office Action issued in counterpart Japanese application No. 2014-143025, dated Jul. 19, 2018.

* cited by examiner

METHOD OF CLEANING A TORCH OF A PLASMA-COATING PLANT AND A PLASMA-COATING PLANT

CROSS-REFERENCE TO RELATED APPLICATIONS

The present application is a divisional of U.S. Ser. No. 14/338,960 filed on Jul. 23, 2014 and claims priority under 35 U.S.C. § 119(a) of European Patent Application No. EP 131 78 146.0 filed Jul. 26, 2013, the disclosure of each of these applications is expressly incorporated by reference herein in its entirety.

BACKGROUND OF THE INVENTION

1. Field of the Invention

The invention relates to a system and method of cleaning a torch of a plasma-coating plant.

2. Discussion of Background Information

Plasma-coating plants and plasma-coating methods are used in order to apply a layer onto surfaces of work pieces. The layer can, for example, serve as a thermal barrier layer for turbine vanes or at cylinder inner surfaces of a crank housing to improve the tribological properties of a combustion motor. A plasma flame is generated by a torch to which plasma flame a spray material forming the layer is supplied, for example in the form of a powder or of a wire, for carrying out a plasma-spray coating. The spray material melts in the plasma flame and is sprayed onto the work piece where it forms the above-mentioned layer. In this respect, however, not all of the completely supplied spray material is deposited on the work piece. Amongst other things, this leads to the fact that spray material particles are deposited at the torch and in this way adhere at the torch. Such contaminations can lead to functional interferences of the torch which influence the quality of the applied layer and/or necessitate the interruption of the coating method.

In the EP 1837081 A1 a method of cleaning a torch of a plasma coating plant and a plasma coating plant are described in which the torch is impinged by pressurized air as a cleaning agent in order to thus remove particles adhering at the torch. For this purpose cleaning nozzles, from which the pressurized air can exit, are directly arranged at the torch.

SUMMARY OF THE EMBODIMENTS

In contrast to this, the invention presents a method of cleaning a torch of a plasma-coating plant and a plasma-coating plant which enable an interference-free operation of the plasma-coating plant.

During the method in accordance with the invention of cleaning a torch of a plasma-coating plant, the torch is impinged by a cleaning agent exiting from a cleaning nozzle during an interruption of a coating process, this means during a phase in which no layer is applied onto a work piece. In this way, spray material particles adhering at the torch are removed.

In accordance with the invention the cleaning agent is designed in such a way that it changes into a gaseous state after leaving the cleaning nozzle. In this respect the cleaning agent directly changes into the gaseous state either from a solid state or from a liquid state. The cleaning agent in this way is sublimed or evaporated after the exiting of the cleaning nozzle. In both cases the cleaning agent has a very low temperature and extremely increases its volume on the change into the gaseous state. If the spray material particles adhering at the torch have already formed a continuous layer, then this is so strongly cooled and cracks start to form. Subsequent particles of the cleaning agent penetrate into these cracks and immediately expand. In this way the spray material particles are split off. If the spray material particles have not yet formed a continuous layer at the torch, particles of the cleaning agent can directly penetrate into gaps and cracks present, whereby a splitting off of the spray material particles is likewise brought about.

In this way the spray material particles adhering at the torch can be removed particularly effectively, so that they cannot bring about any functional interferences of the torch. Moreover, no danger exists of damaging the torch, as can be the case for a mechanical cleaning of the torch.

In particular the plasma is maintained during the cleaning of the torch. In this way no renewed ignition of the plasma is required after the cleaning.

The torch can be impinged by a cleaning agent only coming from one cleaning nozzle or by a cleaning agent coming from a plurality of cleaning nozzles simultaneously or also successively active.

In this connection a "torch" should be understood such that this means both the actual component in which the plasma is generated, as well as those parts which are directly or indirectly connected to this component. An example for such a component would be a so-called torch shaft. In this connection "impinge" should be understood such that it means, for example, sprayed on, blown on or "shot on".

In an embodiment of the invention the cleaning agent is designed in such a way that it is solid prior to the exiting from the cleaning nozzle. The cleaning agent in this respect is in particular dry ice, this means it is solid carbon dioxide ($CO_2$). Dry ice sublimes at normal pressure at approximately −78° C., this means it directly changes into the gas phase, this means the gaseous state without previously becoming liquid. During the sublimation the volume increases to more than the 700-fold.

In this way, on the one hand, a very effective cleaning becomes possible and, on the other hand, dry ice can be obtained simply and cost-effectively so that a cost-effective way of carrying out the method in accordance with the invention is possible.

On its use, a method, for example, referred to as dry ice blasting can be used. In this connection dry ice pellets having a grain size of, for example, between 2 and 8 mm can be accelerated and guided towards the torch. The spray material particles adhering at the torch are then split off as described above.

In an embodiment of the invention the cleaning agent is configured in such a way that it is liquid prior to leaving the cleaning nozzle. In this respect the cleaning agent is in particular liquid nitrogen (N). Liquid nitrogen evaporates at a normal pressure at approximately −196° C. On evaporation the volume increases up to the 700-fold.

In this way, on the one hand, a very effective cleaning becomes possible and, on the other hand, liquid nitrogen can be obtained simply and cost-effectively so that a cost-effective way of carrying out the method in accordance with the invention is possible.

The cleaning agent can advantageously also be liquid carbon dioxide ($CO_2$). On leaving the cleaning nozzle the carbon dioxide relaxes, wherein a part of the carbon dioxide is changed into the gaseous state and a different part changes into a solid state, in particular in the form of snow particles. Such a method is referred to as so-called snow blasting. The mixture of gaseous carbon dioxide and snow particles is in particular admixed to a beam of pressured air and the mixer is so impinged with the cleaning agent.

In this way the carbon dioxide advantageously can be continuously supplied, for example, from immersion tube bottles or low pressure tanks. This enables a continuous coating and cleaning method which can be carried out simply and thus cost-effectively.

The cleaning agent can, however, also be composed of a different material which is gaseous under normal conditions.

On use of a cleaning agent which is liquid prior to leaving the cleaning nozzle the spray material particles adhering at the torch are likewise split off as described above.

In an embodiment of the invention the torch rotates during a coating process, wherein this rotation is stopped prior to the impingement by the cleaning agent. In this way it can be avoided that the cleaning agent is incident at the torch and in such a way that the danger does not arise that the plasma is accidently deactivated and thus has to be re-ignited prior to a renewed coating process.

The rotation of the torch during a coating process in particular takes place about a longitudinal axis of the torch. However, it is also possible that the torch is not rotated during the complete coating process, but rather only intermittently rotated. A rotating torch is, for example, used on a coating of cylinder inner surfaces at a crank housing of a combustion motor.

In an embodiment of the invention the rotation is stopped at a defined cleaning position of the torch, wherein the said cleaning position is, in particular defined in relation to the cleaning nozzle. In this way it can be ensured that the impingement of the torch by a cleaning agent takes place during reproducible conditions and in this way the cleaning also leads to reproducible results.

In order to enable a stopping of the rotation at the defined cleaning position a so-called step motor can, for example, be used for rotating the torch.

In an embodiment of the invention the torch is moved during the impingement by the cleaning agent at a defined cleaning track relative to the cleaning nozzle. In this respect it is, in particular moved in such a way that as large as possible regions of the torch are impinged by the cleaning agent and at the same time sensitive regions which should not come into contact with the cleaning agent can be left blank. In this way it can advantageously be achieved that as large as possible regions of the torch are cleaned without the danger of a deactivation of the plasma arising.

A defined rotation of the torch about its longitudinal axis can also be understood as a movement at a defined cleaning track relative to the cleaning nozzle.

In an embodiment of the invention the torch is driven into a cleaning station prior to the impingement by the cleaning agent. In this way, on the one hand, the torch can be positioned very exactly with respect to the cleaning nozzle and, on the other hand, the spray material particles split off from the torch can be caught and discarded simply.

The cleaning nozzle is in this respect arranged at the cleaning station. The cleaning station further comprises in particular a collection basin and/or a suction for the split-off spray material particles.

The above-mentioned method is also satisfied by a plasma-coating plant having a torch and a cleaning apparatus having a cleaning nozzle. The cleaning apparatus is provided for the purpose of impinging the torch with a cleaning agent exiting from the cleaning nozzle during a coating pause and to thus remove spray material particles adhering at the torch. In accordance with the invention the cleaning agent is designed in such a way that it changes into a gaseous state after exiting the cleaning nozzle.

In an embodiment of the invention the cleaning nozzle is arranged at the torch. In this way only a very short space of time is required for the cleaning of the torch, since the torch does not have to be brought into a specific cleaning station for the cleaning. In order to enable a particularly good cleaning result, also more than one cleaning nozzle can be arranged at the torch.

The invention also provides for a method of cleaning a plasma coating torch, wherein the method comprises subjecting a plasma coating torch to a cleaning agent in order to remove spray material particles which have adhered during coating with the plasma coating torch and during said subjecting, the cleaning agent exits a nozzle and, upon exiting the nozzle, directly changes to a gaseous state from either a solid state or a liquid state.

In embodiments, the subjecting occurs during an interruption of a coating process.

In embodiments, the adhered spray material particles are cooled to a point of crack formation so that the cleaning agent can penetrate crack and expand to such an extent that the adhered spray material particles are split-off.

In embodiments, during said subjecting, the cleaning agent exits a nozzle and, upon exiting the nozzle, directly changes to a gaseous state from a solid state.

In embodiments, during said subjecting, the cleaning agent exits a nozzle and, upon exiting the nozzle, directly changes to a gaseous state from a liquid state.

In embodiments, the cleaning agent is dry ice.

In embodiments, the cleaning agent is liquid nitrogen.

In embodiments, the cleaning agent is liquid carbon dioxide.

In embodiments, the method further comprises, prior to the subjecting, rotating the plasma coating torch during coating.

In embodiments, the method further comprises, prior to the subjecting, stopping a rotation of the plasma coating torch during coating.

In embodiments, the method further comprises, prior to the subjecting, positioning the plasma coating torch at a cleaning location or station.

In embodiments, the method further comprises, prior to the subjecting, moving the plasma coating torch to a defined cleaning position.

In embodiments, the method further comprises, during the subjecting, collecting removed spray material particles.

The invention also provides for a plasma coating torch cleaning system comprising at least one nozzle configured to subject a plasma coating torch to a cleaning agent in order to remove spray material particles which have adhered during coating with the plasma coating torch. The cleaning agent exits the at least one nozzle and directly changing to a gaseous state from either a solid state or a liquid state.

In embodiments, the at least one nozzle is one of positioned adjacent the plasma coating torch, mounted to a part of the plasma coating torch, and movable with the plasma coating torch.

The invention also provides for a method of cleaning a plasma coating torch, wherein the method comprises subjecting a plasma coating torch to a cleaning agent in order to remove spray material particles which have adhered during coating with the plasma coating torch and during said subjecting, the cleaning agent subjects the adhered spray material particles to cooling to a point of crack formation so as to cause a removal of the adhered spray particles.

In embodiments, the method further comprises, during the subjecting, collecting the removed spray material particles.

In embodiments, during said subjecting, the cleaning agent exits a nozzle and, upon exiting the nozzle, directly changes to a gaseous state from a solid state.

In embodiments, during said subjecting, the cleaning agent exits a nozzle and, upon exiting the nozzle, directly changes to a gaseous state from a liquid state.

In embodiments, the cleaning agent is dry ice in a gaseous state.

In embodiments, the cleaning agent is one of liquid nitrogen changed into a gaseous state and liquid carbon dioxide changed into a gaseous state.

BRIEF DESCRIPTION OF THE DRAWINGS

Further advantages, features and particulars of the invention result from the subsequent description of embodiments, as well as with reference to the drawing in which like or functionally like elements are provided with identical reference numerals.

In the drawings there is shown the following.

DETAILED DESCRIPTION OF THE EMBODIMENTS

Figure 1:
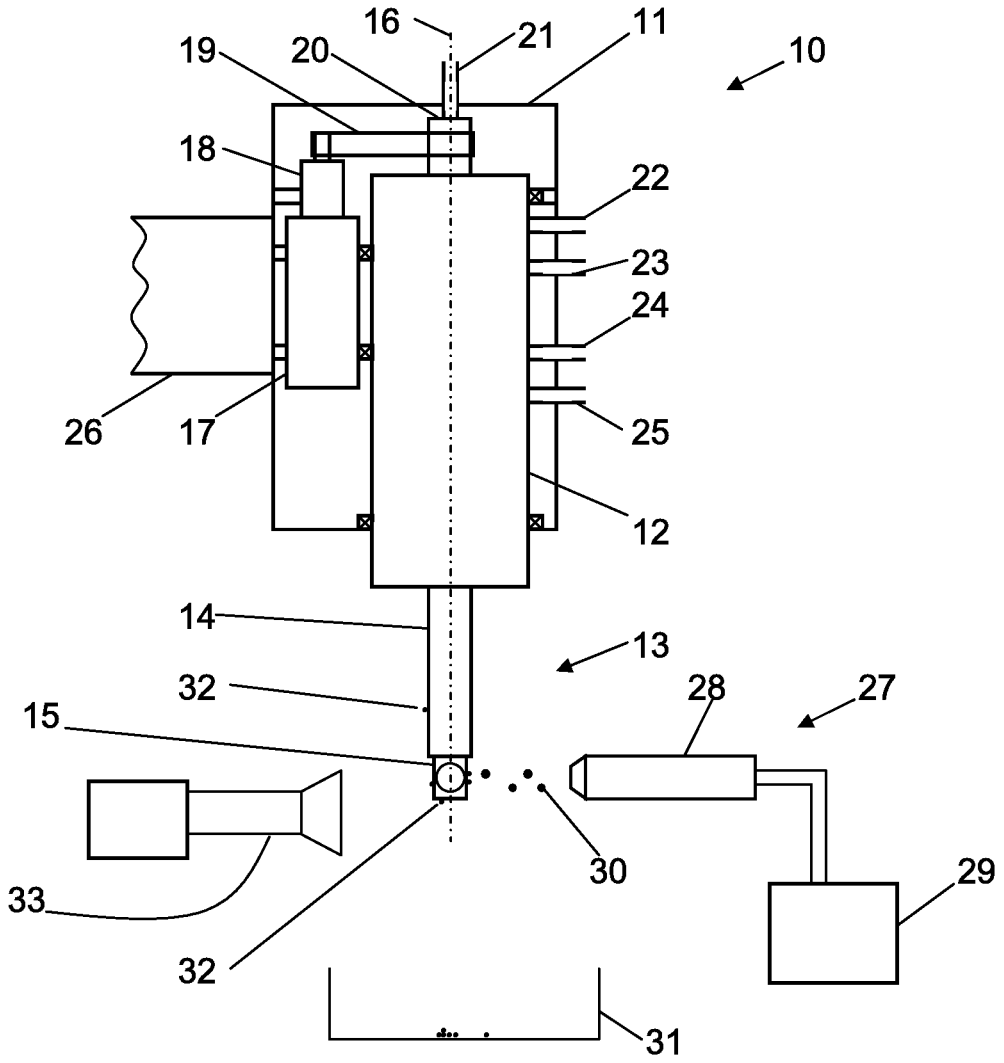
FIG. 1 show a very schematically illustrated plasma spray device of a plasma coating plant having a torch in a cleaning station.

In accordance with FIG. 1 a plasma spray device 10 of a non-further illustrated plasma coating plant has a housing 11, a connection element 12 partly arranged in the housing 11 and a torch 13. The torch 13 comprises a substantially cylindrical torch shaft 14 via which it is fixedly connected to the connection element 12 and a torch head 15 disposed opposite of the connection element 12. The connection element 12 and in this way also the torch 13 can rotate about a longitudinal axis 16. For this purpose an electric motor 17 configured as a step motor is arranged within the housing 11, said electric motor being connected drive wise to a drive shaft 20 of the connection element 12 via a gear 18 and a toothed belt 19 with the drive shaft being arranged coaxially with respect to the longitudinal axis 16. The operating media required for the operation of the plasma spray device 10 are supplied and also partly discharged via connections 21, 22, 23, 24 and 25. Coating material in the form of powder can be supplied via the connection 21 arranged at the drive shaft 20 coaxially with respect to the longitudinal axis 16. The other connections 22, 23, 24 and 25 are arranged transverse with respect to the longitudinal axis 16 at the housing 11. Cooling water is supplied via the connection 22 and led away again via the connection 23. Air is supplied via the connection 24 and plasma gas, for example, in the form of argon, helium, hydrogen, nitrogen or mixtures thereof is supplied via the connection 25. The individual lines for the operating media within the connection element 12 and the torch 13, as well as the associated rotary feed-throughs are of no further interest in this case and for this reason are also not illustrated.

The housing 11 of the plasma spray device 10 is connected to a non-illustrated industrial robot via an only partly illustrated coupling module 26, with said industrial robot being able to bring the plasma spray device 10 into a desired position. In this way the plasma spray device 10 can also be positioned such that the torch 13 is present in a cleaning station 27. The cleaning station 27 has a cleaning nozzle 28 which is connected to an only schematically illustrated supply unit 29 for the cleaning agent 30. The supply unit 29 can supply the cleaning nozzles 28 with cleaning agent 30 which can be applied at the torch 13 under pressure so that the torch 13 can be impinged by the cleaning agent 30. The cleaning station 27 moreover has a collection basin 31 above which the torch 13 is positioned during a cleaning process. The cleaning station 27 furthermore has a suction 33 besides which the torch 13 is positioned during a cleaning process.

The plasma spray device 10 is, for example, used for the coating of cylinder inner surfaces of a crank housing of a combustion motor. During the coating, this means during a coating process, the torch 13 rotates about the longitudinal axis 16 in this respect. On the application of spray material at the cylinder inner surface also spray material particles 32 are deposited at the torch 13 which should be removed during an interruption of the coating process, in particular during the time in which a new crank housing is brought into the correct position. For this purpose, the plasma spray device is positioned in such a way that the torch 13 is present in the cleaning station 27 as is illustrated, with the plasma remaining active. At the same time the rotation of the torch 13 is stopped such that it is present at a defined cleaning position with respect to the cleaning nozzle 28. Subsequently, the torch head 15 is impinged by the cleaning agent 30 in the form of dry ice pellets which are shot against the torch head 15 by way of pressurized air. The dry ice pellets sublime after their exit from the cleaning nozzles 28. The low temperature and the volume increase on sublimation ensure that spray material particles 32 adhering at the torch head 15 are removed from the torch head 15 and are caught in the collection basin 31 or are sucked away by the suction 33.

The torch 13 can be stopped during the cleaning process at a fixed cleaning position. However, it is also possible that the torch 13 is moved on a defined cleaning track relative to the cleaning nozzle 28 during the cleaning process. For this purpose, for example, the torch 13 can be simply rotated, wherein the cleaning track is selected such that the plasma is not directly impinged with cleaning agent, this means the torch 13 is, for example, rotated by about approximately 180 to 250°. Alternatively or additionally, the torch 13 can be moved such that, apart from the torch head 15, also the torch shaft 14 is impinged by the cleaning agent 30. For this purpose, the torch 13 is moved downwardly in the FIG. 1, this means in direction of the collection basin 31. However, it is also possible that the cleaning nozzle is moved and not the torch.

Instead of dry ice, for example, also liquid nitrogen for liquid carbon dioxide can be used as a cleaning agent.

Figure 2:
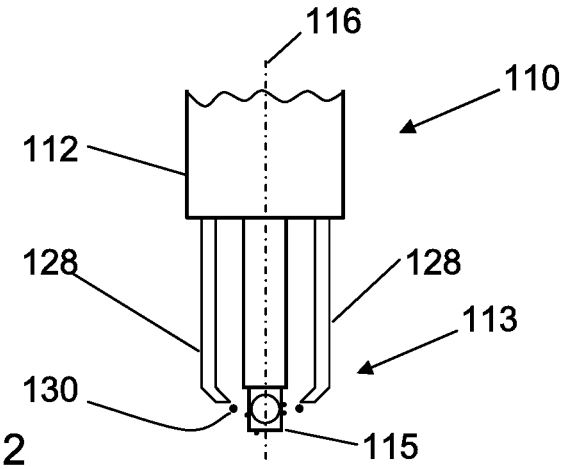
FIG. 2 shows a part of a very schematically illustrated plasma spray device having a torch and two cleaning nozzles arranged at the torch.

A part of a plasma spray device 110 having a different arrangement of cleaning nozzles 128 is illustrated in FIG. 2. The plasma spray device 110 is otherwise assembled like the plasma spray device 10 of FIG. 1 so that reference is only made with respect to the differences. The cleaning nozzles 128 are fastened to a connection element 112 and in this way are arranged at a torch 113 in such a way that they can impinge a torch head 115 of the torch 113 with a cleaning agent 130. The cleaning nozzles 128 are arranged diametrically opposite with respect to a longitudinal axis 116 in this connection. They are supplied with a cleaning agent via a non further illustrated connection at the connection element 112 and via corresponding lines in the connection element 112. In this respect generally the same cleaning agents can be used as were described in connection with the method described in FIG. 1.

It is also possible that only one cleaning nozzle or more than two, this means, for example three or four cleaning nozzles are provided.

What is claimed:

1. A method of cleaning a plasma coating torch, comprising a movable and rotatable plasma coating torch configured to generate a plasma and apply a coating inside a cylindrical surface, utilizing a plasma coating torch cleaning system that comprises at least one nozzle mounted so as to be directed at the plasma coating torch in order to subject an external surface of the plasma coating torch to a cleaning agent that removes spray material particles, which have adhered to the external surface of the plasma coating torch during a coating operation with the plasma coating torch, wherein the cleaning agent exiting the at least one nozzle is constituted to directly change to a gaseous state from either a solid state or a liquid state, the method comprising:

subjecting the plasma coating torch to the cleaning agent to remove spray material particles, which have adhered to the external surface during the coating operation with the plasma coating torch, wherein during said subjecting, the cleaning agent exits the at least one nozzle and, upon exiting the at least one nozzle, the cleaning agent directly changes to a gaseous state from either a solid state or a liquid state; and moving the plasma coating torch between a position where the plasma coating torch applies a coating inside the cylindrical surface and a defined cleaning position where the external surface of the plasma coating torch is subjected to the cleaning agent while the plasma coating torch generates the plasma and when there is an interruption of the coating operation with the plasma coating torch.

2. The method of claim 1, wherein the adhered spray material particles are cooled to a point of crack formation so that the cleaning agent can penetrate cracks and expand to such an extent that the adhered spray material particles are split-off.

3. The method of claim 1, wherein during said subjecting, the cleaning agent exits the at least one nozzle and, upon exiting the at least one nozzle, directly changes to a gaseous state from a solid state.

4. The method of claim 1, wherein during said subjecting, the cleaning agent exits the at least one nozzle and, upon exiting the at least one nozzle, directly changes to a gaseous state from a liquid state.

5. The method of claim 1, wherein the cleaning agent is dry ice.

6. The method of claim 1, wherein the cleaning agent is liquid nitrogen.

7. The method of claim 1, wherein the cleaning agent is liquid carbon dioxide.

8. The method of claim 1, further comprising, prior to the subjecting, rotating the plasma coating torch during coating.

9. The method of claim 1, further comprising, prior to the subjecting, stopping a rotation of the plasma coating torch during coating.

10. The method of claim 1, further comprising, prior to the subjecting, positioning the plasma coating torch at a cleaning location or station.

11. The method of claim 1, further comprising, prior to the subjecting, moving the plasma coating torch to the defined cleaning position.

12. The method of claim 1, further comprising, during the subjecting, collecting removed spray material particles.

13. A method of cleaning a plasma coating torch that utilizes a movable and rotatable plasma coating torch configured to generate a plasma and rotate inside a cylindrical surface that will receive a coating, a coupling module configured to mount the rotating plasma coating torch to a robot and at least one nozzle mounted so as to be directed at the plasma coating torch in order to subject an external surface of the plasma coating torch to a cleaning agent that removes spray material particles that have adhered to the external surface of the plasma coating torch during a coating operation with the plasma coating torch, the method comprising:

moving the plasma coating torch between a first position where the plasma coating torch applies the coating to the cylindrical surface and a second position defined as a cleaning position where the external surface of the plasma coating torch is subjected to the cleaning agent while the plasma coating torch generates the plasma and when there is an interruption of the coating operation with the plasma coating torch, and when in the second position, causing the cleaning agent to exit the at least one nozzle in a direction toward the external surface of the plasma torch, wherein the cleaning agent exiting the at least one nozzle directly changes to a gaseous state from either a solid state or a liquid state.

14. A method of cleaning a plasma coating torch that utilizes a rotatable plasma coating torch configured to generate a plasma and to rotate inside an engine cylinder that will receive a coating and at least one nozzle mounted so as to be directed at the movable plasma coating torch to subject an external surface of the plasma coating torch to a cleaning agent that removes spray material particles, which have adhered to the external surface of the plasma coating torch during a coating operation with the plasma coating torch, the method comprising:

moving the plasma coating torch between a coating position and a defined cleaning position, said coating position being a position where the plasma coating torch applies the coating to the engine cylinder, and said defined cleaning position being a position where, while the plasma coating torch generates the plasma and when there is an interruption of coating with the plasma coating torch, the external surface of the plasma coating torch is subjected to the cleaning agent.

* * * * *